United States Patent [19]

Nishi et al.

[11] Patent Number: 4,737,778

[45] Date of Patent: Apr. 12, 1988

[54] VIDEO DISPLAY CONTROLLER

[75] Inventors: Kazuhiko Nishi; Takatoshi Ishii; Ryozo Yamashita, all of Tokyo; Shigemitsu Yamaoka; Takatoshi Okumura, both of Hamamatsu, all of Japan

[73] Assignees: Ascii Corporation, Tokyo; Nippon Gakki Seizo Kabushiki Kaisha, Hamamatsu, both of Japan

[21] Appl. No.: 736,827

[22] Filed: May 22, 1985

[30] Foreign Application Priority Data

May 25, 1984 [JP] Japan ..... 59-106093

[51] Int. Cl.[4] ..... G09G 1/16

[52] U.S. Cl. ..... 340/724; 340/726; 340/749

[58] Field of Search ..... 340/723, 724, 725, 747, 340/750, 726, 749

[56] References Cited

U.S. PATENT DOCUMENTS

| | | | |
|---|---|---|---|
| 3,988,728 | 10/1976 | Inoue et al. | 340/724 X |
| 4,020,483 | 4/1977 | Baumgarten | 340/724 |
| 4,112,422 | 9/1978 | Mayer et al. | 340/724 |
| 4,189,728 | 2/1980 | Stubben | 340/721 X |
| 4,259,725 | 3/1981 | Andrews et al. | 340/724 X |
| 4,441,104 | 4/1984 | Finney, II | 340/724 |
| 4,527,154 | 7/1985 | Taaka | 340/721 |
| 4,533,910 | 8/1985 | Sukonick et al. | 340/724 |

*Primary Examiner*—Marshall M. Curtis

*Attorney, Agent, or Firm*—Cushman, Darby & Cushman

[57] ABSTRACT

There is provided a video display controller which can vertically and horizontally shift a whole video image displayed on a screen of a video display unit. The video display controller comprises an image data read circuit which reads the image data from a video RAM, a register into which data representative of amount of shift of the video image is stored by a central processing unit, and a first counter which cyclicly counts a clock signal. An adder adds the data contained in the register and a count output of the first counter, and at a timing determined by this addition result a predetermined value is preset into a second counter. This second counter counts the clock signal from the predetermined value, and the image data read by the image data read circuit is outputted to the video display unit at a timing in accordance with a count output of this second counter. The register, first counter, adder and second counter are provided in each of vertical and horizontal scanning control circuits.

5 Claims, 4 Drawing Sheets

VIDEO DISPLAY CONTROLLER

BACKGROUND OF THE INVENTION

1. Field of the Invention

The present invention relates to a video display controller for use in terminal equipment for a computer, television game apparatus or the like.

2. Prior Art

Recently, various kinds of display control systems which display animation and still images on a screen of a CRT (cathode-ray tube) display unit under the control of a CPU (central processing unit) have been developed. FIG. 1 shows one example of such conventional systems which comprises a video display controller (hereinafter referred to as "VDP") 1 and a central processing unit (CPU) 2. The system further comprises a memory 3 which includes a ROM (read only memory) for storing a variety of programs to be executed by the CPU 2 and a RAM (random access memory) for storing other necessary data. The CPU 2 outputs data representative of still and animation images to be displayed on a screen of a CRT display unit 4 to the VDP 1 which in turn stores the still and animation data into a video RAM (hereinafter referred to as "VRAM") 5.

The VDP 1 comprises two interface circuits 6 and 7, an image date processing circuit 8, a horizontal counter (H counter) 9, a vertical counter (V counter) 10, and two decoders 11 and 12. The H counter 9 is a binary counter having a count range of "0" to "340" for counting a clock pulse $\phi$ having a cycle of 186.2 nsec. Each time the clock pulse $\phi$ is counted 341 times, the H counter 9 outputs a pulse signal CP to the V counter 10. The time period, during which the H counter 9 counts the clock pulse $\phi$ 341 times, coincides with the sum of a horizontal scanning period and a horizontal blanking period of the screen of the CRT display unit 4. The V counter 10 is a binary counter having a count range of "0" to "261" for counting the pulse signal CP. The time period, during which the V counter 10 counts the pulse signal CP 262 times, coincides with the sum of a vertical scanning period and a vertical blanking period of the CRT display unit 4. The image date processing circuit 8 reads out the image data previously stored in the VRAM 5 in response to a display command supplied from the CPU 2, and displays a color video image on the screen of the CRT display unit 4 in accordance with the read image data. More specifically, the image date processing circuit 8 produces a horizontal synchronization signal and a vertical synchronization signal in accordance with outputs of the decoders 11 and 12 and then combines these synchronization signals to form a composite synchronization signal CSYNC to be supplied to the CRT display unit 4. Also, the image data processing circuit 8 determines the color of display element (dot) at each dot display position on the display screen in accordance with the image date read from the VRAM 5, and sequentially outputs color signals R, G and B (red, green and blue) in accordance with the scanning position on the screen designated by the outputs of the decoders 11 and 12. The color signals R, G and B outputted from the image data processing circuit 8 are supplied to the CRT display unit 4 to thereby display color dots on the screen of the CRT display unit 4.

Such a conventional video display controller described above is so constructed that color signals R, G and B for displaying the leftmost display element on each horizontal scanning line of the screen are outputted a predetermined time period after the corresponding horizontal synchronization signal is issued. However, due to the difference in characteristic of the CRT display unit 4, the display element designated by the color signals R, G and B outputted at the above time instant is not always displayed at the leftmost position of the screen, and it is unavoidable that the display element is displayed at a position on the screen which is deviated a distance corresponding to several display elements rightwardly or leftwardly from the correct display position. In this case, the whole video image is displayed in an area of the screen which is shifted to the left or to the right from the correct display area of the screen, so that the leftmost portion or the rightmost portion of the video image may be hidden. The same kind of problem as above may also occur with regard to the display operation in the vertical direction of the screen. Thus, with the conventional video display controller, the overall display image on the screen cannot have been horizontally or vertically moved to correct its display position and to recover the hidden portion of the image.

SUMMARY OF THE INVENTION

It is therefore an object of the present invention to provide a video display controller which can vertically and horizontally move a whole display image displayed on a screen of a video display unit.

According to one aspect of the present invention, there is provided a video display controller adapted to be connected to a central processing unit, a video display unit and memory means storing image data, for displaying under the control of the central processing unit a video image represented by the image data on a screen of the video display unit in accordance with a clock signal, the video display controller comprising (a) register means for receiving data from the central processing unit; (b) first counter means for counting the clock signal to output a first count output; (c) operation means for effecting an operation on the first count output and the data received by the register means for outputting an operation result; (d) second counter means for being preset with a first predetermined value at a timing determined by the operation result and for counting the clock signal to output a second count output; and (e) reading means for reading the image data from the memory means; (f) the video display controller outputting the image data in accordance with the second count output to the video display unit to display the video image in an area on the screen determined by said data. In this case, the operation means may be composed of an adder. The video display controller may further comprise circuit means for generating a timing signal when the operation result becomes equal to a second predetermined value, the second counter means presetting the first predetermined value thereinto in response to the timing signal. Also, the register means, first counter means, operation means, and second counter means may be provided in each of vertical and horizontal scanning control circuit portions of the video display controller.

DESCRIPTION OF THE PREFERRED EMBODIMENT OF THE INVENTION

Figure 1:
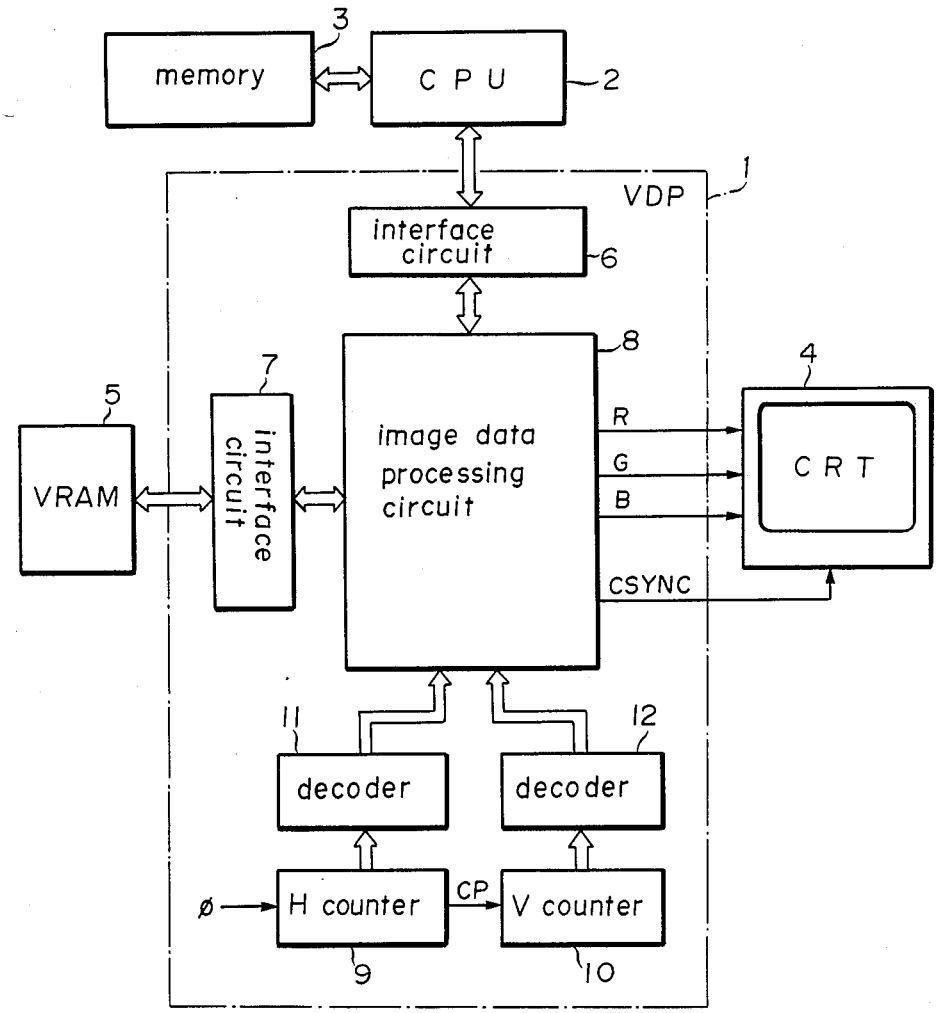
FIG. 1 (PRIOR ART)
FIG. 1 is a block diagram of a video display control system including a conventional video display controller.
Figure 2:
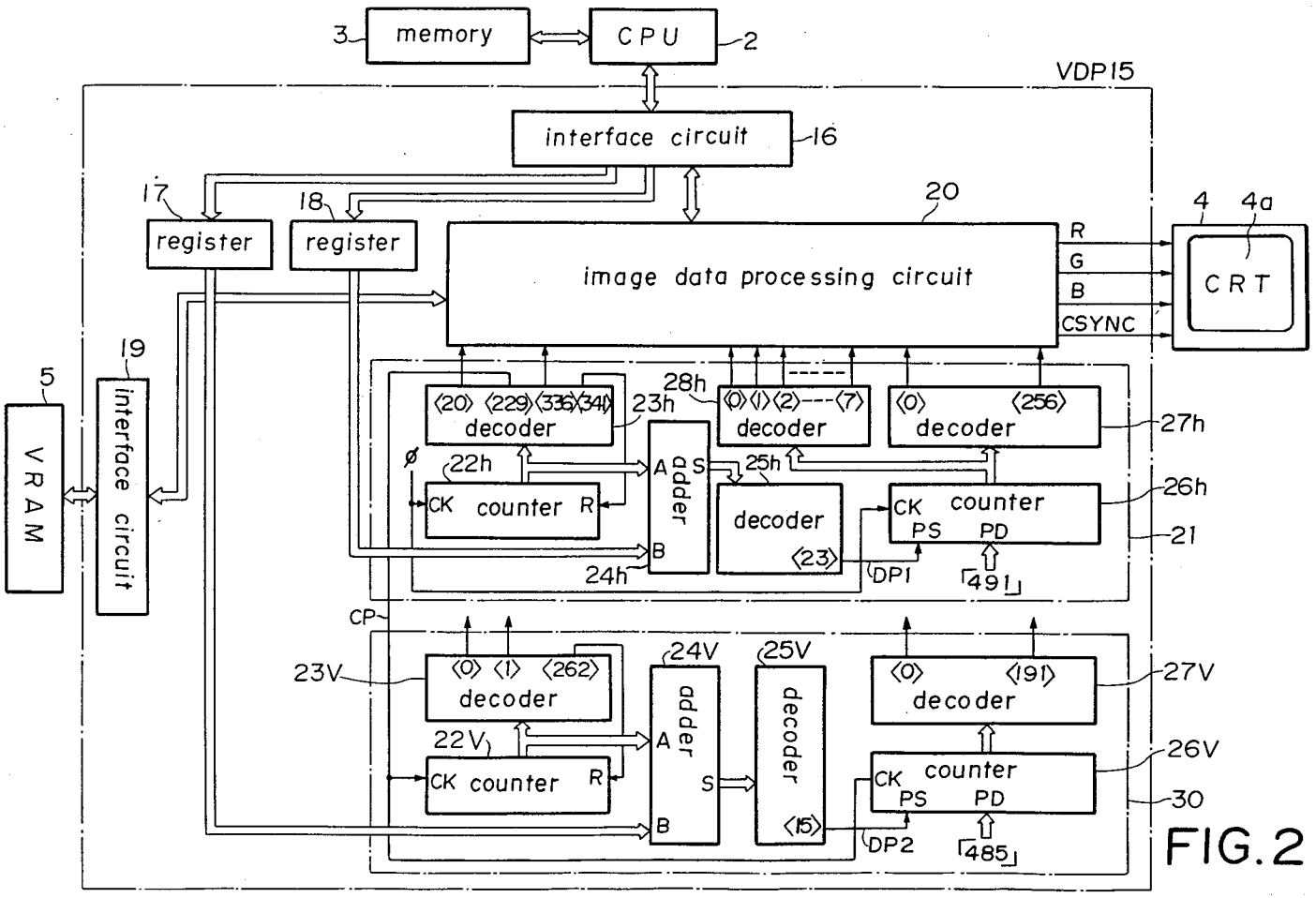
FIG. 2 is a block diagram of a video display control system including a video display controller 15 provided in accordance with the present invention.
Figure 3:
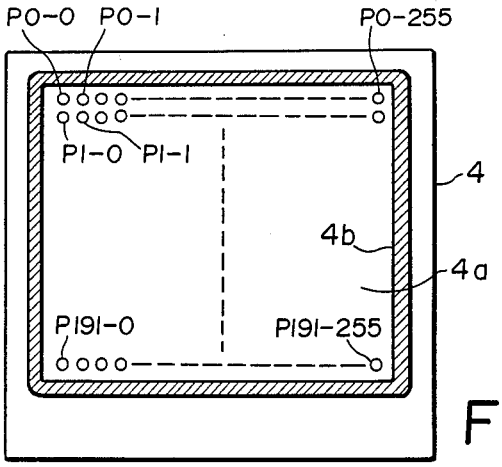
FIG. 3 is an illustration showing a display screen of a CRT display unit 4 of the video display system of FIG. 2.

A video display control system having a video display controller (VDP) 15 provided in accordance with the present invention will now be described with reference to FIGS. 2 to 5, in which parts corresponding to those of the system shown in FIG. 1 are denoted by like reference numerals. The VDP 15 shown in FIG. 2 is designed to display a video image consisting of 256 columns of 192 rows of display elements on a display screen **4*a* of a CRT display unit 4, as shown in FIG. 3. There is provided on the screen 4*a* a border area (non-display area) 4*b* at the peripheral marginal portion thereof, and display elements in this border area 4*b*** are displayed in a specific backdrop color. The time period for displaying each display element is set to 186.2 nsec and all display elements on the screen are repeatedly displayed at a frequency of 60 Hz.

Figure 4:
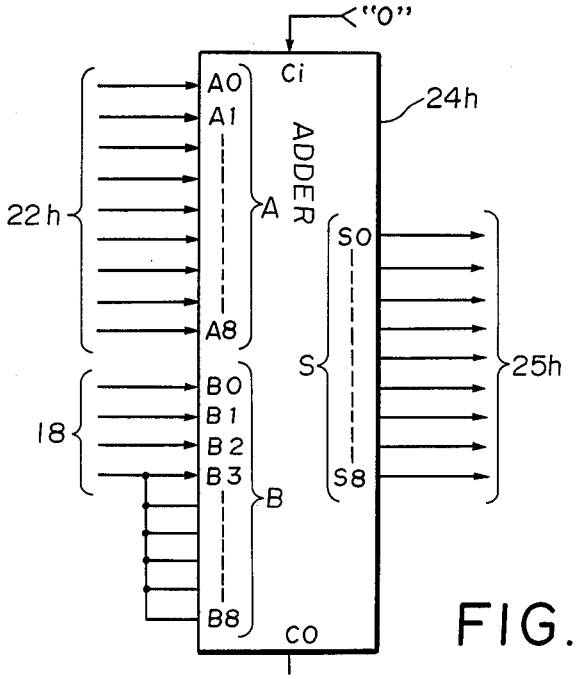
FIG. 4 is an illustration showing an adder **24*h* provided in the video display controller 15 of the system of FIG. 2.

The VDP 15 will now be more fully described. The VDP 15 comprises an interface circuit 16, two registers 17 and 18 into each of which four-bit data is written by a CPU 2 through the interface circuit 16, an interface circuit 19, an image data processing circuit 20, a horizontal timing signal generator 21, and a vertical timing signal generator 30. The horizontal timing signal generator 21 comprises a nine-bit counter **22*h* for up-counting a clock pulse $\phi$ of a period of 186.2 nsec, a count output of this counter 22*h* sequentially varying in a range of "0" to "340". The count output of this counter 22*h* is supplied to a decoder 23*h* and to a data input port A of an adder 24*h*. Shown at <20>, <229>, <336>, and <341> are output termianls of the decoder 23*h* which output "1" signals when the count output of the counter 22*h* becomes "20", "229", "336" and "341", respectively. Signals outputted from the output terminals <20> and <336> are supplied to the image data processing circuit 20, and a signal outputted from the output terminal <229> is supplied as a signal CP to each clock terminal CK of counters 22*v* and 26*v* provided in the vertical timing signal generator 30. A signal outputted from the output terminal <341> is supplied to a reset input terminal R of the counter 22*h*. The decoder 23*h* also has other output terminals for supplying signals to the image data processing circuit 20, however, since these signals are not directly concerned with the present invention, their descriptions are omitted here. The adder 24*h* adds the count output (nine bits) of the counter 22*h* applied to the data input port A thereof to an output (four bits) of the register 18 applied to another data input port B thereof. As shown in FIG. 4, the output of the register 18 is supplied to input terminals B0 (LSB) to B3 of the data input port B of the adder 24*h*, whereas input terminals B4 to B8 of the port B are connected to the input terminal B3. A signal at a carry out terminal C0 of this adder 24*h* is not used. A decoder 25*h* outputs a pulse signal DP1 ("1" singal) when an output (9-bit) of the adder 24*h* becomes "23". The pulse signal DP1 is supplied to a preset terminal PS of a preset counter 26*h*. The preset counter 26*h* is a presettable nine-bit binary counter for up-counting the above clock pulse $\phi$ and is supplied with preset date of "491" at its preset data terminal PD. A count output of the preset counter 26*h* is supplied to a decoder 27*h*, while the lower three bits of the count output are supplied to a decoder 28*h*. Outputs of the decoders 27*h* and 28*h* are supplied to the image data processing circuit 20**.

The vertical timing signal generator 30 has substantially the same construction as that of the above-described horizontal timing signal generator 21, in which parts and components corresponding to those of the generator 21 are designated by the same reference numerals except that their suffixes "h" are replaced by suffixes "v". The counter **22*v* of the vertical timing signal generator 30 is a nine-bit binary counter for up-counting the pulse signal CP and its count output sequentially varies in a range of "0" to "261". A decoder 25*v* outputs a pulse signal DP2 ("1" signal) when an output of an adder 24*v* becomes "15". A preset counter 26*v* is a presettable nine-bit binary counter for up-counting the signal CP and is supplied with data of "485" at its preset data terminal PD. Outputs of the decoders 23*v* and a decoder 27*v* are supplied to the aforesaid image data processing circuit 20**.

Upon receipt of a display command from the CPU 2, the image data processing circuit 20 reads the image data from the VRAM 5 and displays a video image on the display screen of the CRT display unit 4 in accordance with the read image data and in accordance with the outputs of the decoders **23*h*, 27*h*, 28*h*, 23*v*, and 27*v*. More specifically, the image data processing circuit 20 produces a horizontal synchronization signal HSYNC (refer to FIG. 5**-(*a*)), which falls in response to the "1" signal outputted from the output terminal <336> of the decoder **23*h* and rises in response to the "1" signal outputted from the output terminal <20> of the decoder 23*h*, and also produces a vertical synchronization signal VSYNC (not shown) which falls in response to the "1" signal outputted from the output terminal <0> of the decoder 23*v* and rises in response to the "1" signal outputted from the output terminal <1> of the decoder 23*h*. The image data processing circuit 20 combines the horizontal synchronization signal with the vertical synchronization signals VSYNC to form a composite synchronization signal CSYNC and outputs this composite synchronization signal CSYNC to the CRT display unit 4. Also, when the "1" signal is outputted from the output terminal <0> of the decoder 27*v* and when the "1" signal is outputted from the output terminal <0> of the decoder 27*h*, the image data processing circuit 20 outputs to the CRT display unit 4, color signals R, G and B to display the first display element P0-0 shown in FIG. 3 on the screen. Thereafter, in a similar manner, the image data processing circuit 20 sequentially outputs the color signals R, G and B in synchronization with the variation of the output of the decoder 28*h*, i.e., at an interval of 186.2 nsec, to display the succeeding display elements P0-1, P0-2, . . . The image data processing circuit 20 stops the output of the color signals R, G and B at the leading edge of the signal outputted from the output terminal <256> of the decoder 27*h*. In accordance with the above-mentioned processing, the respective (256) display elements on the first (uppermost) scanning line of the screen are displayed. The image data processing circuit 20 outputs the color signals R, G and B to display the display element P1-0 shown in FIG. 3 when the signal at the output terminal <0> of the decoder 27***h* again rises, and thereafter the image data processing circuit 20 sequentially outputs to the CRT display unit 4 the color signals R, G and B in synchronization with the variation of the output of the decoder 28*h* to display the succeeding display elements P1-1, P1-2, . . . The output of the color signals is stopped at the leading edge of the signal outputted from the output terminal <256> of the decoder 27*h*. And thereafter, the foregoing operation is repeated. The display of one frame of video image is completed when the "1" signal is outputted from the output terminal <191> of the decoder 27*v* and when the "1" signal is outputted from the output terminal <256> of the decoder 27*h*. The foregoing is the processing of the image data processing circuit 20 in which one frame of video image is displayed. The processing circuit 20 carries out the foregoing processing sixty times per one second to thereby display on the screen of the CRT display unit 4 a stable video image represented by the image data.

The horizontal movement of the whole image displayed on the screen will now be described.

Figure 5:
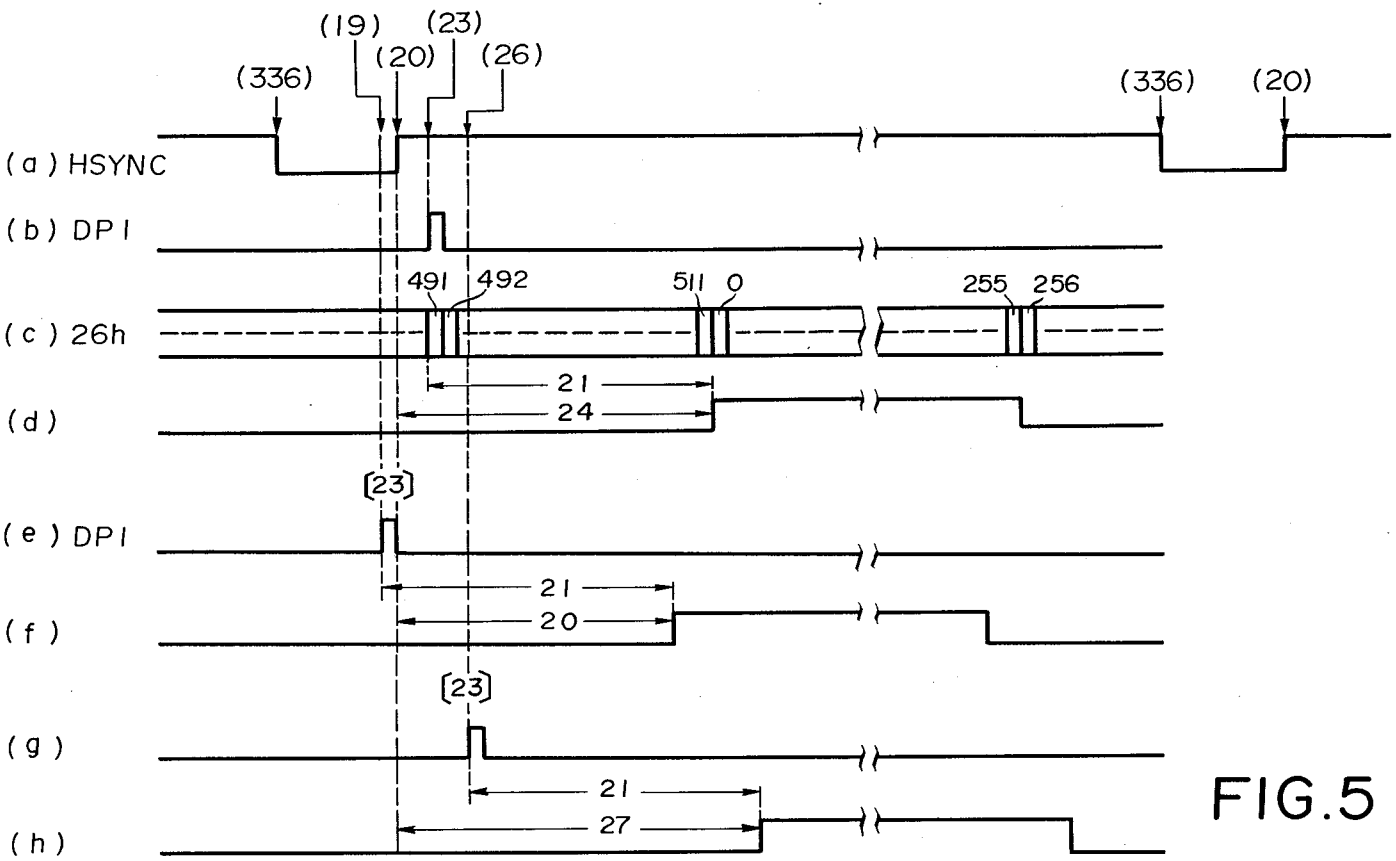
FIG. 5 is a timing chart of various signals appearing in the video display controller 15** of FIG. 2.

It is now assumed that, for instance, the CPU 2 stores binary data "0000" into the register 18 (hereinafter, this state is referred to as "normal state"). In this case, the output of the adder 24*h* becomes equal to the output of the counter 22*h*, so that the output pulse signal DP1 of the decoder 25*h* is generated when the count output of the counter 22*h* becomes "23", as shown in FIG. 5-(*b*). In response to this pulse signal DP1, the counter 26*h* presets thereinto a value "491". Thereafter, the output of the counter 26*h* varies in accordance with the clock pulse $\phi$ as shown in FIG. 5-(*c*). Since the counter 26*h* is a nine-bit binary counter, the maximum value of its count output is "511". The display of one row of display elements on a horizontal scanning line is started from the time when the count output of the counter 26*h* becomes "0", and the display of one row of display elements (256 display elements) on the horizontal scanning line is completed when the output of the counter 26*h* becomes "256". From this, it will be appreciated that the display period of one row of display elements on a horizontal scanning line (horizontal display period) is the period shown in FIG. 5-(*d*). As will be obvious from the above description, the horizontal display period begins at a time point 21 clock pulses $\phi$ after the leading edge of the pulse signal DP1. And in the case of the normal state, the horizontal display period begins at a time point 24 clock pulses $\phi$ after the leading edge of the horizontal synchronization signal HSYNC.

Next, it is assumed that the CPU 2 stores, for example, a decimal value "+4" into the register 18. The storage of the value is carried out by storing binary data "0, 0, 1" into the first (LSB) to third bits of the register 18 and by storing binary data "0" indicative of "+" into the fourth bit (MSB) thereof. In this case, "4" is added to the count output of the counter 22*h* by the adder 24*h*, so that the pulse signal DP1 is outputted from the decoder 25*h* when the count output of the counter 22*h* is "19", as shown in FIG. 5-(*e*). And the horizontal display period begins at a time point 21 clock pulses $\phi$ after the pulse signal DP1 is outputted (refer to FIG. 5-(*f*)). Thus, the horizontal display period begins at a time point 20 clock pulses $\phi$ after the leading edge of the horizontal synchronization signal HSYNC. In other words, the horizontal display period in this case begins at a time point four clock pulses $\phi$ earlier than the beginning of the horizontal display period in the normal state with respect to the leading edge of the horizontal synchronization signal HSYNC. As a result, the position of the overall display image is shifted to the left of the screen by four display elements with respect to the position of the image in the normal state. Incidentally, in FIG. 5, each count output of the counter 22*h* is indicated by a value in parenthesis "()", while each output of the adder 24*h* is indicated by a value in parenthesis "[]".

It is now assumed that the CPU 2 stores decimal data of, for example, "−3" into the register 18. The storage of the data is performed by storing the two's complement of "3", which is "1, 0, 1", into the first to third bits of the register 18 and binary data "1" indicative of "−" into the fourth bit of the register 18. In this case, "3" is subtracted from the count output of the counter 22*h* by the adder 24*h*, so that the pulse signal DP1 is outputted from the decoder 25*h* when the count output of the counter 22*h* is "26" as shown in FIG. 5-(*g*). The horizontal display period therefore begins at a time point 21 clock pulses $\phi$ after the pulse signal DP1 is outputted (refer to FIG. 5-(*h*)). Thus, in this case, the horizontal display period begins at a time point 27 clock pulses $\phi$ after the leading edge of the horizontal synchronization signal HSYNC. In other words, the horizontal display period begins at a time point 3 clock pulses $\phi$ later than the beginning of the horizontal scanning period in the normal state. As a result, the position of the overall display image on the screen is moved to the right by a distance corresponding to three display elements with respect to the position of the image displayed in the normal state.

With the foregoing embodiment, the whole display image on the screen can be horizontally moved, by a distance of up to seven display elements and designated by the four-bit data written into the register 18 by the CPU 2, to the right or left with repect to the display position of the image in the normal state. In a similar manner, the whole display image on the screen can also be vertically moved, by a distance of up to seven display elements and designated by the four-bit data written into the register 17 by the CPU 2, upwardly or downwardly of the screen with repect to the display position of the image in the normal state.

As described above, the video display controller according to the present invention can horizontally and vertically move the whole vidoe image displayed on the screen by a selected distance on a display element unit basis. This video display controller can therefore correct the horizontal and vertical displacement of image caused by the difference in display characteristic of the CRT display unit so that the hidden portion of the image due to the displacement is displayed. Furthermore, with the structure of this video display controller, horizontal and vertical scrolling of a video image displayed on the screen can also be achieved.

What is claimed is:

1. A video display controller adapted to be connected to a central processing unit, a video display unit and memory means storing image data, for displaying under the control of the central processing unit a video image represented by the image data on a screen of the video display unit in accordance with a clock signal, said video display controller comprising:

(a) register means operatively connected to the central processing unit for receiving and storing therein data supplied from the central processing unit;

(b) first counter means for counting the clock signal to output a first count output;

(c) operation means operatively connected to said register means and said first counter means for effecting an arithmetic operation on said first count output and said data in said register means for outputting an operation result;

(d) circuit means responsive to said operation result for outputting a timing signal when said operation result becomes equal to a first predetermined value;

(e) second counter means which is preset with a second predetermined value in response to said timing signal for counting the clock signal to output a second count output; and (f) reading means responsive to said second count output for reading the image data from the memory means;

(g) said video display controller outputting the image data read by said reading means to the video display unit to thereby display the video image on the screen at a position determined by said data in said register means.

2. A video display controller according to claim 1, wherein said operation means is an adder which adds said first count output and said data in said register means together to output an addition result as said operation result.

3. A video display controller according to claim 1, wherein said video display controller comprises a vertical scanning control circuit portion and a horizontal scanning control circuit portion, each of said vertical and horizontal scanning control circuit portions comprising said register means, said first counter means, said operation means, said circuit means and said second counter means, and wherein said reading means is responsive to said second count output from said second counter means of each of said vertical and horizontal scanning control circuit portions for reading the image data from the memory means.

4. A video display controller adapted to be connected to a central processing unit, a video display unit and memory means storing image data, for displaying under the control of the central processing unit a video image represented by the image data on a screen of the video display unit in accordance with a clock signal, said video display controller comprising:

(a) register means operatively connected to the central processing unit for receiving and storing therein data supplied from the central processing unit;

(b) first counter means for counting the clock signal to output a first count output;

(c) operation means operatively connected to said register means and said first counter means for effecting an arithmetic operation on said first output and said data in said register means for outputting an operation result;

(d) second counter means which is preset with a second predetermined value when said operation result is in a first predetermined condition and for counting the clock signal to output a second count output; and (e) reading means responsive to said second count output for reading the image data from the memory means;

(f) said video display controller outputting the image data read by said reading means to the video display unit to thereby display the video image on the screen at a position determined by said data in said register means.

5. A video display controller according to claim 4 further comprising circuit means for generating a timing signal when said operation result becomes equal to a second predetermined value, said second counter means being preset with said first predetermined value thereinto in response to said timing signal.

* * * * *